US011130655B2

(12) United States Patent
Dube et al.

(10) Patent No.: US 11,130,655 B2
(45) Date of Patent: Sep. 28, 2021

(54) ELEVATOR CAR DYNAMIC SAG DAMPING SYSTEM

(71) Applicant: Otis Elevator Company, Farmington, CT (US)

(72) Inventors: Randall S. Dube, Glastonbury, CT (US); Patricia Derwinski, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 347 days.

(21) Appl. No.: 16/238,310

(22) Filed: Jan. 2, 2019

(65) Prior Publication Data

US 2019/0210840 A1 Jul. 11, 2019

Related U.S. Application Data

(60) Provisional application No. 62/615,783, filed on Jan. 10, 2018.

(51) Int. Cl.
*B66B 11/02* (2006.01)
*B66B 17/34* (2006.01)

(52) U.S. Cl.
CPC ..... *B66B 11/0273* (2013.01); *B66B 11/0293* (2013.01); *B66B 17/34* (2013.01)

(58) Field of Classification Search
CPC .. B66B 11/0273; B66B 17/34; B66B 11/0293
See application file for complete search history.

(56) References Cited

U.S. PATENT DOCUMENTS

| | | | |
|---|---|---|---|
| 1,684,433 | A | 9/1928 | Crowell |
| 1,709,301 | A | 4/1929 | Bassett |
| 4,899,852 | A | 2/1990 | Salmon et al. |
| 5,005,671 | A | 4/1991 | Aime et al. |
| 6,431,325 | B1 | 8/2002 | Bledsoe et al. |
| 7,546,904 | B2 | 6/2009 | Wernas |
| 8,733,023 | B2 | 5/2014 | Rahardjo et al. |
| 8,746,411 | B2 | 6/2014 | Roberts et al. |
| 9,321,610 | B2 | 4/2016 | Fargo et al. |
| 2006/0180404 | A1 | 8/2006 | Christen |

(Continued)

FOREIGN PATENT DOCUMENTS

| | | | |
|---|---|---|---|
| CN | 201236084 | Y | 5/2009 |
| CN | 105060043 | A | 11/2015 |

(Continued)

OTHER PUBLICATIONS

Machine Translation of CN 2012236084.*

(Continued)

*Primary Examiner* — Diem M Tran
(74) *Attorney, Agent, or Firm* — Cantor Colburn LLP

(57) ABSTRACT

A damping device for damping movement of a parked car in an elevator system includes a base plate and at least one damping assembly connected to the base plate. The damping assembly includes a flange extending from the base plate, a support member arranged at a distance from the flange, and at least one damping mechanism having a first end connected to the flange and a second end connected to the support member. The at least one damping assembly restricts movement of the support member toward the flange.

16 Claims, 6 Drawing Sheets

(56) References Cited

U.S. PATENT DOCUMENTS

| | | | |
|---|---|---|---|
| 2012/0048657 | A1 | 3/2012 | Christen |
| 2016/0325968 | A1 | 11/2016 | Baker et al. |

FOREIGN PATENT DOCUMENTS

| | | | |
|---|---|---|---|
| CN | 205061251 | U | 3/2016 |
| CN | 106006280 | A | 10/2016 |
| CN | 106115432 | A | 11/2016 |
| GB | 1316551 | A | 5/1973 |
| JP | H0475985 | A | 3/1992 |
| JP | H0769558 | A | 3/1995 |
| WO | 03037773 | A1 | 5/2003 |

OTHER PUBLICATIONS

Chinese Office Action; International Application No. 201910019637.8; International Filing Date: Jan. 9, 2019; dated May 8, 2020; 7 pages.

Second Office Action; Chinese Application No. 201910019637.8; International Filing Date: Jan. 9, 2019; dated Jan. 8, 2021; 7 pages with translation.

* cited by examiner

RED - MOVEMENT WITHOUT DAMPING SYSTEM
GREEN - MOVEMENT WITH DAMPING SYSTEM

RED - MOVEMENT WITHOUT DAMPING SYSTEM
GREEN - MOVEMENT WITH DAMPING SYSTEM

ELEVATOR CAR DYNAMIC SAG DAMPING SYSTEM

CROSS-REFERENCE TO RELATED APPLICATIONS

This application claims the benefit of U.S. Provisional Application Ser. No. 62/615,783, filed Jan. 10, 2018, which is incorporated herein by reference in its entirety.

BACKGROUND

The subject matter disclosed herein relates generally to elevator systems, and more particularly, to dynamic sag of a roping member of an elevator system.

A typical elevator system includes a machine for moving the elevator car to provide elevator service. In traction-based systems, a roping arrangement including two or more roping members suspends the weight of the elevator car and a counterweight. Traction between the roping arrangement and a traction sheave that is driven by the elevator machine provides the ability to move the elevator car as desired.

When the rise of an elevator system is sufficiently large, the extended length, elasticity, and damping characteristics of the roping members introduces the possibility for an elevator car to bounce or oscillate as a result of a change in load while the elevator car is at a landing. For example, passenger or freight loading and unloading may initiate oscillation of dynamic movement of the car. In some cases, elevator passengers may perceive a bounciness of the elevator car, which is undesirable.

There are various known devices for holding an elevator car fixed at a landing. Brake devices have been proposed that actively dampen movement of the elevator car via a modulated clamping force applied to a guide rail or other stationary structure within the hoistway. Another type uses rigid physical coupling. Such devices, however, are typically complex and require not only power but also a control software for proper operation.

Additionally, many such devices introduce noise. There is therefore a need for an improved way of stabilizing an elevator car when it is stopped.

BRIEF SUMMARY

In one embodiment, a damping device for damping movement of a parked car in an elevator system includes a base plate and at least one damping assembly connected to the base plate. The damping assembly includes a flange extending from the base plate, a support member arranged at a distance from the flange, and at least one damping mechanism having a first end connected to the flange and a second end connected to the support member. The at least one damping assembly restricts movement of the support member toward the flange.

Additionally or alternatively, in this or other embodiments the at least one damping mechanism includes a plurality of damping mechanisms, the plurality of damping mechanisms being substantially identical.

Additionally or alternatively, in this or other embodiments the at least one damping mechanism is tunable to achieve a desired stiffness.

Additionally or alternatively, in this or other embodiments the at least one damping mechanism includes a damper and biasing mechanism.

Additionally or alternatively, in this or other embodiments the at least one damping mechanism includes a magnetic spring.

Additionally or alternatively, in this or other embodiments wherein the at least one damping mechanism includes a magnet.

Additionally or alternatively, in this or other embodiments the at least one damping assembly includes a first damping assembly and a second damping assembly.

Additionally or alternatively, in this or other embodiments a clearance is defined between the support member of the first damping assembly and the support member of the second damping assembly.

Additionally or alternatively, in this or other embodiments a coupling component connected to the parked car is receivable within the clearance.

Additionally or alternatively, in this or other embodiments the first damping assembly is operable to restrict movement of the parked car in a first direction and the second damping assembly is operable to restrict movement of the parked car in a second, opposite direction.

According to another embodiment, an elevator system includes an elevator car, a plurality of load bearing members suspending the elevator car for movement between a plurality of parked positions, a coupling component, and a damping device engagable with the coupling component at one of the plurality of parked positions. One of the coupling component and the damping device is mounted to the elevator car. The damping device has at least one damping assembly including a flange, a support member arranged at a distance from the flange, and at least one damping mechanism having a first end connected to the flange and a second end connected to the support member. The at least one damping assembly restricts movement of the elevator car in at least a first direction.

Additionally or alternatively, in this or other embodiments when the coupling component and the damping device are engaged, the coupling component is arranged in contact with the support member.

Additionally or alternatively, in this or other embodiments the damping device includes a first damping assembly and a second damping assembly, wherein the first damping assembly restricts movement of the elevator car in a first direction and the second damping assembly restricts movement of the elevator car in a second, opposite direction.

Additionally or alternatively, in this or other embodiments a clearance is defined between the support member of the first damping assembly and the support member of the second damping assembly.

Additionally or alternatively, in this or other embodiments when the coupling component and the damping device are engaged, the coupling component is receive within the clearance, the clearance being smaller than the coupling component.

Additionally or alternatively, in this or other embodiments the elevator car includes a car door and the damping device is aligned with car door when the elevator car is at one of the plurality of parked positions.

According to yet another embodiment, a method of controlling a position of an elevator car includes stopping the elevator car in a desired position, engaging a coupling component and a damping device located at the desired position, initially deflecting at least one damping assembly of the damping device, and further deflecting the at least one damping assembly of the damping assembly in response to oscillation of the elevator car at the desired position.

Additionally or alternatively, in this or other embodiments the elevator car is at a landing when in the desired position.

Additionally or alternatively, in this or other embodiments one of the coupling component and the damping device is coupled to a movable component of the elevator car.

Additionally or alternatively, in this or other embodiments the at least one damping assembly includes a first damping assembly and a second damping assembly and wherein engaging a coupling component and a damping device located at the desired position includes receiving the coupling component within a clearance defined by the first damping assembly and the second damping assembly.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
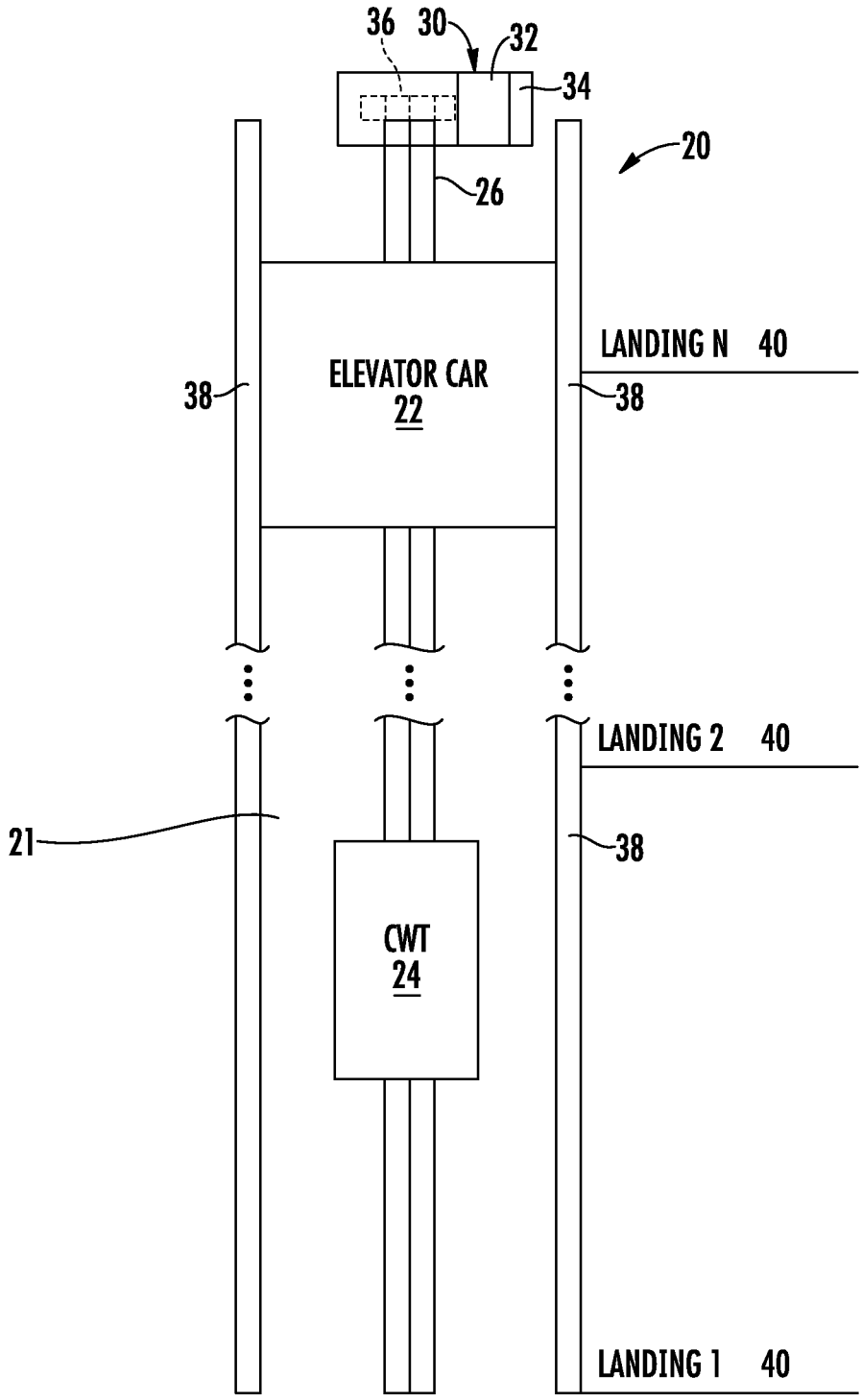
FIG. 1 is schematically illustrating portions of an example elevator system.

With reference to FIG. 1, selected portions of an example of an elevator system 20 are illustrated schematically. An elevator car 22 disposed within a hoistway 21 is coupled with a counterweight 24. A plurality of load bearing members 26 forms a roping arrangement for suspending the load of the elevator car 22 and the counterweight 24. Any suitable type of load bearing member 26 is contemplated herein. Examples of load bearing members 26 suitable for use in an elevator application include, but are not limited to, flat belts and steel cables for example.

An elevator machine 30 includes a motor 32 and a brake 34 operably coupled to a traction sheave 36 to control movement thereof. Traction between the load bearing members 26 and a surface of the traction sheave 36 provides control over the movement and position of the elevator car 22. For example, when energized, the motor 32 rotates the traction sheave 36 about an axis, resulting in a corresponding movement of the load bearing members 26 to achieve a desired movement of the elevator car 22 along guide rails 38 between a plurality of landings 40 associated with the hoistway 21.

The brake 34 and/or a motor drive (not shown) is operable to slow and/or restrict rotation of the traction sheave 36 to stop or hold the elevator car 22 stationary at a desired vertical position along the guide rails 38. In an embodiment, the load bearing members 26 have a construction and a length that introduces the possibility for the elevator car 22 to bounce or oscillate vertically relative to a desired parking position.

Figure 2:
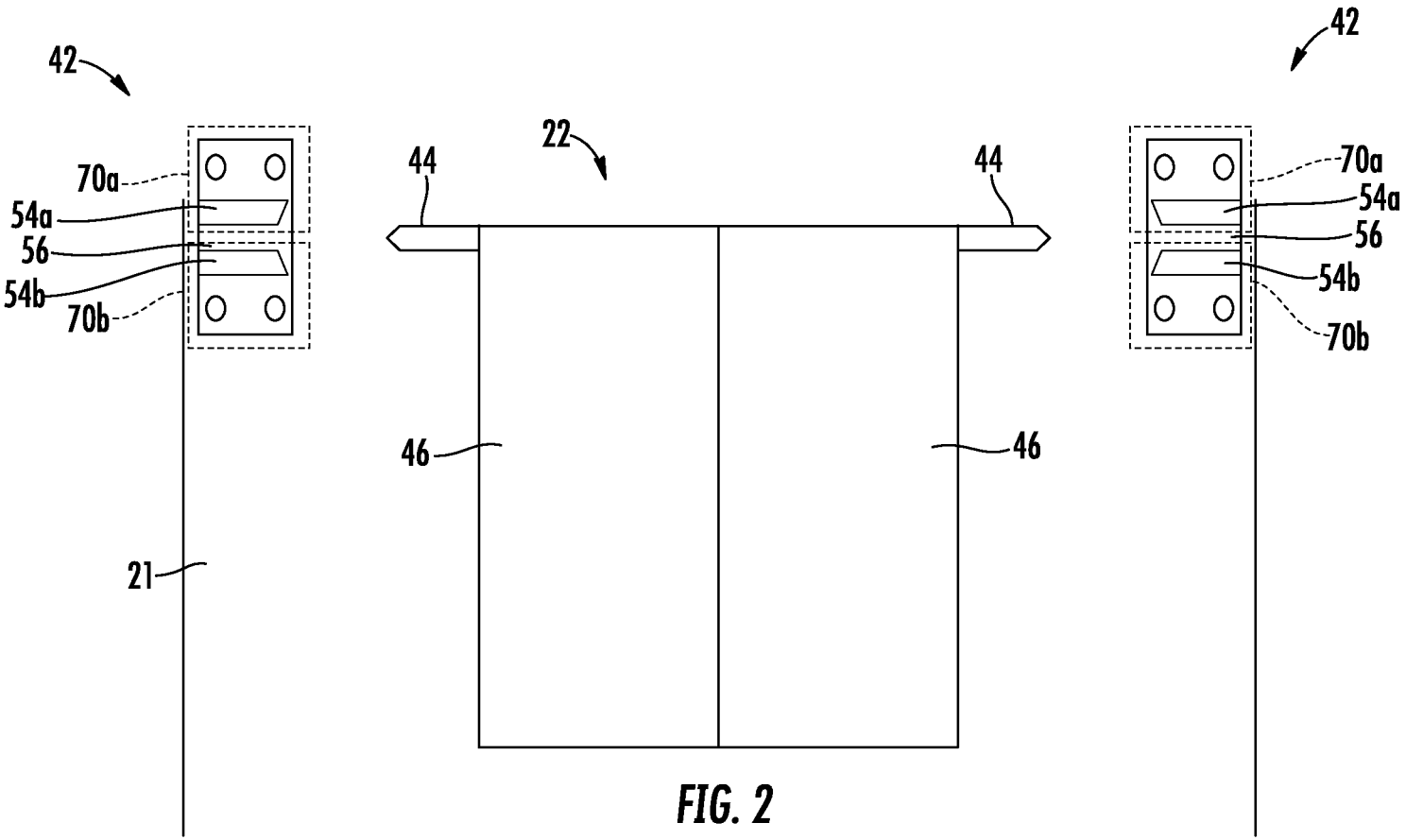
FIG. 2 is a schematic illustration of an elevator car decoupled from a damping device according to an embodiment.
Figure 3:
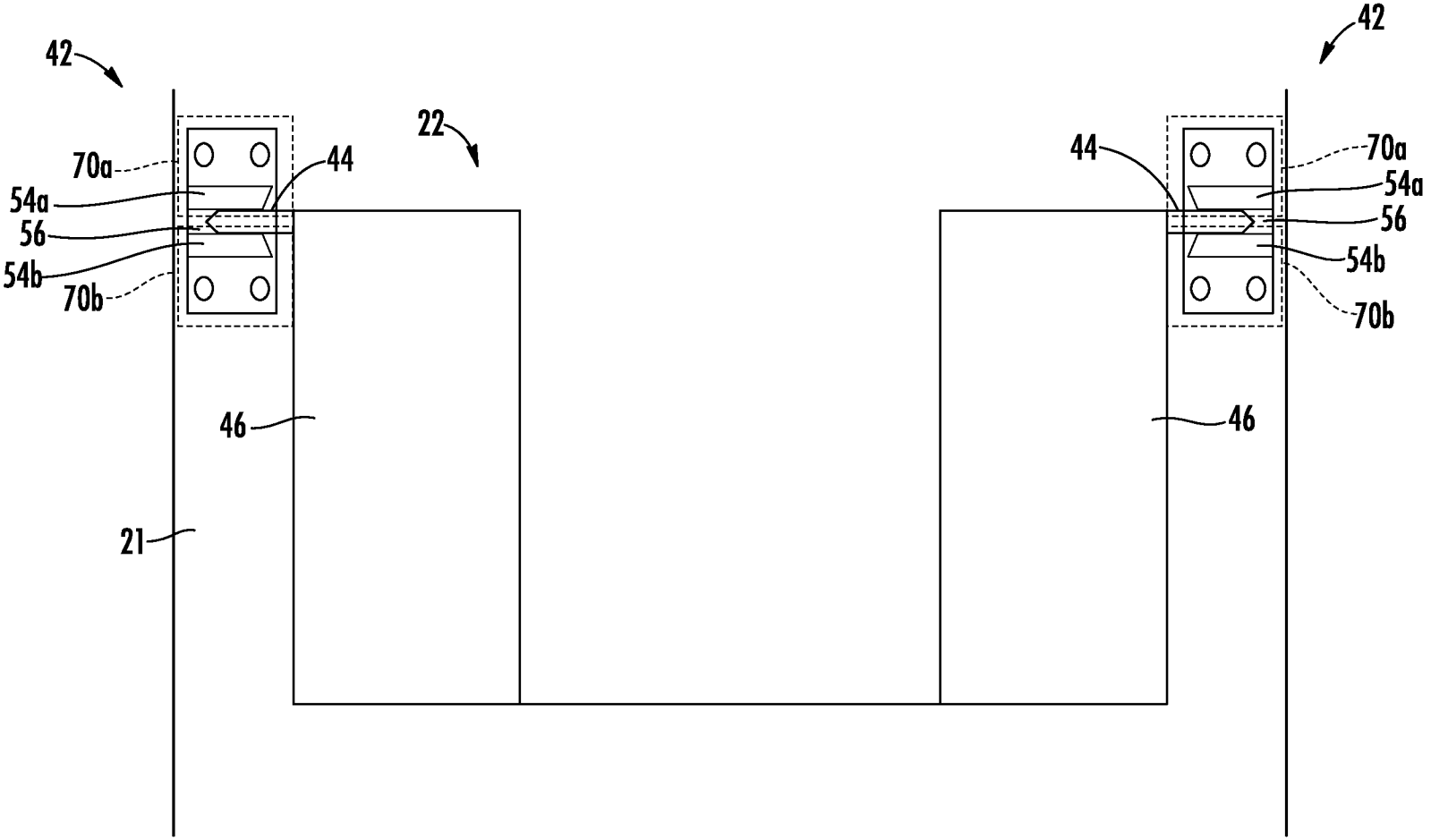
FIG. 3 is a schematic illustration of a parked elevator car coupled to a damping device according to an embodiment.
Figure 4:
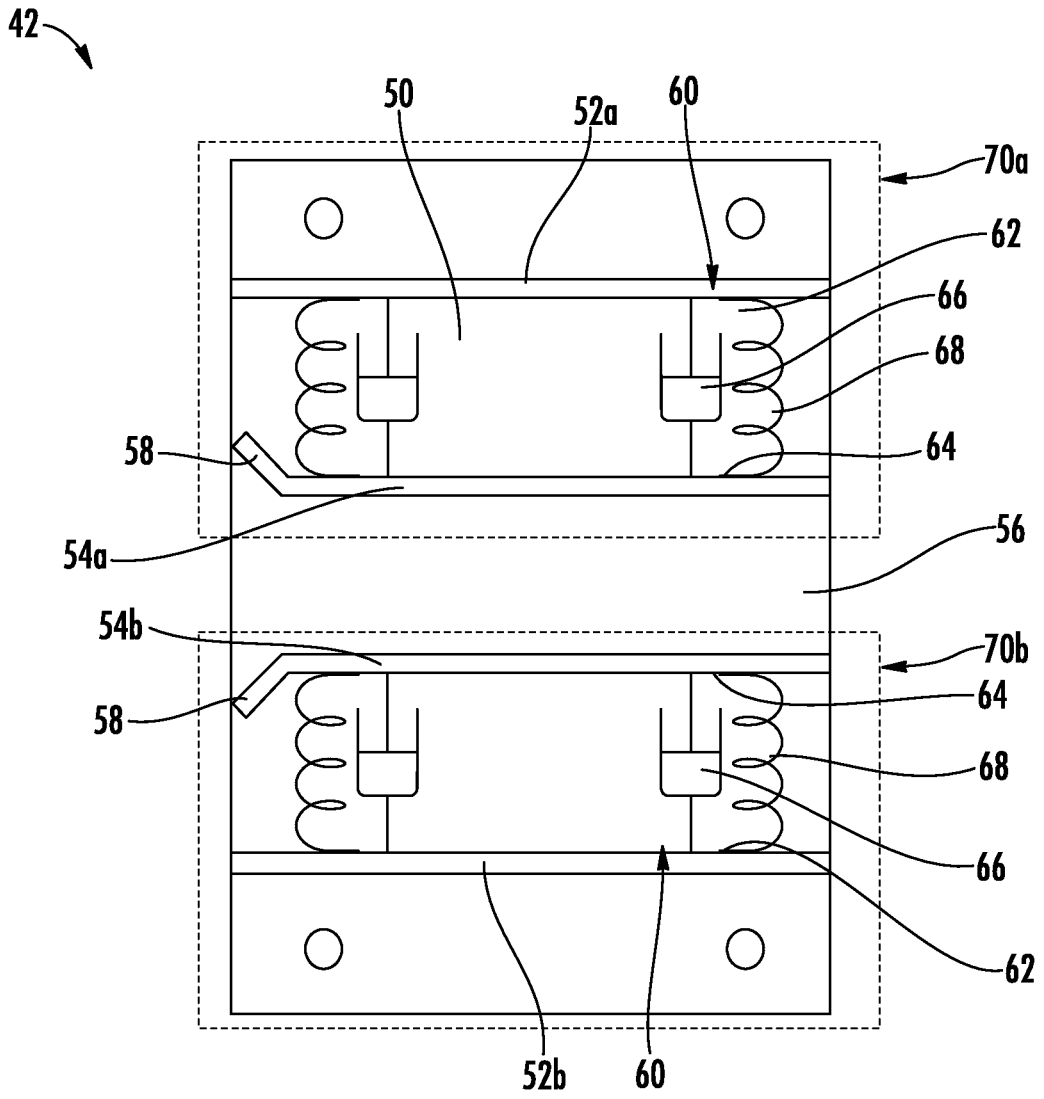
FIG. 4 is a plan view of a damping device according to an embodiment.

With continued reference to FIG. 1 and further reference to FIGS. 2-4, a plurality of damping devices 42 (see FIG. 2) may be mounted at various locations throughout the hoistway 21. The clamping devices 42 in this example engage a portion of the elevator car 22 to dampen any bouncing or oscillating movement of the elevator car 22 when the elevator car 22 is located at a desired parking position.

A coupling component 44 configured to engage a damping device 42 may extend from a portion of the elevator car 22. Although the coupling component 44 is illustrated as being mounted to a car door 46, the coupling component 44 may be mounted at any suitable location relative to the elevator car 22. The coupling component 44 is illustrated in the non-limiting embodiment as a bracket or bar; however, it should be understood that a coupling component 44 having any configuration including a surface configured to cooperate with the damping device 42 is within the scope of the disclosure.

An example of a damping device 42 for use in an elevator system 20 is illustrated in more detail in FIG. 4. The damping device 42 includes at least one base plate 50 for mounting to a surface of the elevator system 20 and at least one flange 52 extending substantially perpendicular to the surface of the base plate 50. In the illustrated, non-limiting embodiment, the damping device 42 includes a single base plate 50 having a first flange 52*a* and a second flange 52*b* extending therefrom. The first flange 52*a* and the second flange 52*b* are separated by a distance. However, embodiments including only a single flange 52 extending from a base plate 50 are also within the scope of the disclosure. For example, the damping device 42 may include a first base plate having a first flange extending therefrom and a second base plate having a second flange extending therefrom.

The one or more flanges 52 may be coupled to the base plate 50, such as via fasteners or a weld for example. Alternatively, the flange(s) 52 and base plate 50 may be integrally formed. For example, in embodiments where a single flange 52 extends from a base plate 50, the base plate 50 and flange 52 may be formed from an angle or T-shaped channel. Similarly, a C-shaped or U-shaped channel may be used to form an integrally formed base plate 50, a first flange 52*a*, and a second flange 52*b*.

A rigid support member 54 is movably connected to a flange 52. In embodiments including a plurality of flanges 52, a distinct support member 54 is operably coupled to each of the plurality of flanges 52. The support member 54 may, but need not be oriented generally parallel to a corresponding flange 52. In the illustrated, non-limiting embodiment, the damping device 42 includes a first support member 54*a* connected to a first flange 52*a* and a second support member 54*b* connected to a second flange 52*b*. As best shown in FIG. 2, a clearance 56 for receiving the coupling component 44 of the elevator car 22 is formed between the first support member 54*a* and the second support member 54*b*. In an embodiment, each support member 54*a*, 54*b* includes an angled first end 58 to facilitate receipt of the coupling component 44 within the clearance 56. The angles formed in the first and second support member 54*a*, 54*b* may, but need not, be opposite and equal as shown.

Each support member 54*a*, 54*b* is operably coupled to a flange 52*a*, 52*b* via one or more damping mechanisms 60. In embodiments including a plurality of damping mechanisms 60, the plurality damping mechanisms 60 may be identical, as shown, or may be different. As shown, a first end 62 of each damping mechanism 60 is connected to a flange 52 and a second, opposite end 64 of each damping mechanism 60 is connected to a support member 54. In the illustrated, non-limiting embodiment, two damping mechanisms 60 are used to couple a support member 54 to a corresponding flange 52; however, it should be understood that embodiments including any number of damping mechanisms 60, including a single damping mechanism 60 and more than two damping mechanisms 60 are within the scope of the disclosure.

The damping mechanism 60 may include any suitable device or mechanism for controlling and/or restricting movement of the support member 54 relative to the flange 52. In an embodiment, as shown in the FIG., the damping mechanism 60 includes a damper 66 for controlling the speed of movement of the support member 54 relative to the flange 52 and a biasing mechanism 68, such as a spring for example, for opposing the movement of the support member 54 driven by engagement with the coupling component 44. Alternatively or in addition, the damping mechanism 60 may include one or more of a magnetic spring, a compressed fluid, an elastomeric damping material, and magnets. It should be understood that any suitable device for limiting movement of the support member 54 toward the flange 52 connected to the support member 54 is contemplated herein.

Through engagement between the coupling component 44 and the support member 54, the damping assembly 70 formed by the coupled support member 54, flange 52, and at least one damping mechanism 60, is operable to restrict movement of the coupling component 44 in a given direction. Accordingly, in an embodiment, the damping device 42 includes a first damping assembly 70*a* for limiting movement of the coupling component 44 in a first direction and a second damping assembly 70*b* for limiting movement of the coupling component 44 in a second direction. The first and second directions may be opposite directions and the configuration of the first and second assemblies may, but need not be the same. Further, when used in an elevator system 20, the damping device 42 may be positioned such that the first direction and the second direction are associated with the up and down vertical movement of the elevator car 22 within the hoistway 21.

With reference to FIGS. 2 and 3, the one or more damping devices 42 within the hoistway 21 are mounted adjacent a position where the elevator car 22 may be parked, such as at a landing 40 for example. In an embodiment, at least one damping device 42 is arranged at each landing 40 of the hoistway 21. In another embodiment, at least one damping device 42 is positioned only at the landings or parked positions where oscillation of the elevator car 22 has been identified as a problem.

Damping devices 42 are shown located on opposing sides of the elevator car 22. Although the illustrated damping devices 42 are aligned about a horizontal axis, embodiments where the damping devices 42 are vertically offset are also contemplated herein. Further, in other embodiments, a single damping device 42 may be located adjacent the car 22, or alternatively, multiple damping devices 42 may be arranged adjacent the same side of the car 22. It should also be understood that although the coupling component 44 is illustrated and described as being connected to the elevator car 22 and the damping device 42 is illustrated and described as being fixed within the hoistway 21, such as at the wall to which the landing doors are mounted, embodiments where the coupling component 44 is fixed in the hoistway 21 and the damping device 22 is mounted to a movable component of the elevator car 22 are also contemplated herein.

As the elevator car 22 moves throughout the hoistway 21 (FIG. 2), the one or more coupling components 44 are arranged at a retracted position, decoupled and away from a corresponding damping device 42. When the elevator car 22 ultimately stops at a desired parking position, the coupling components 44 of the car 22 are substantially aligned with a damping device 42 such that the coupling component 44 is positioned generally adjacent a support member 54 of the damping device 42. In the parking position, the elevator car doors 46 open causing the coupling component 44 to translate or move into engagement with the damping device 42, as shown in FIG. 3. In embodiments where the damping device 42 includes a single damping assembly 70, the coupling component 44 is positioned in contact with the support member 54 thereof. Alternatively, in embodiments where the damping device 42 includes a first damping assembly 70*a* and a second damping assembly 70*b*, as previously described, the coupling component 44 is received within the clearance 56 defined between the first and second support members 54*a*, 54*b*. The clearance 56 may be sized slightly smaller than the coupling component 44 such that installation of the coupling component 44 results in an initial deflection of the damping mechanisms 60.

If the elevator car tries to oscillate vertically in either a first direction or both a first and second direction, the coupling component 44 will apply a force to a corresponding support member 54 of the damping device 42. The one or more damping mechanisms 60 coupled to the support member 54 oppose movement of the support member 54 in the direction of the force, i.e. toward the corresponding flange 52. By limiting this additional movement of the support members 54, the position of the elevator car 22 is stabilized. As the elevator doors 46 close, the coupling component 44 disengages from the damping device 42 to allow the elevator car 22 to move freely without interference.

Figure 5:
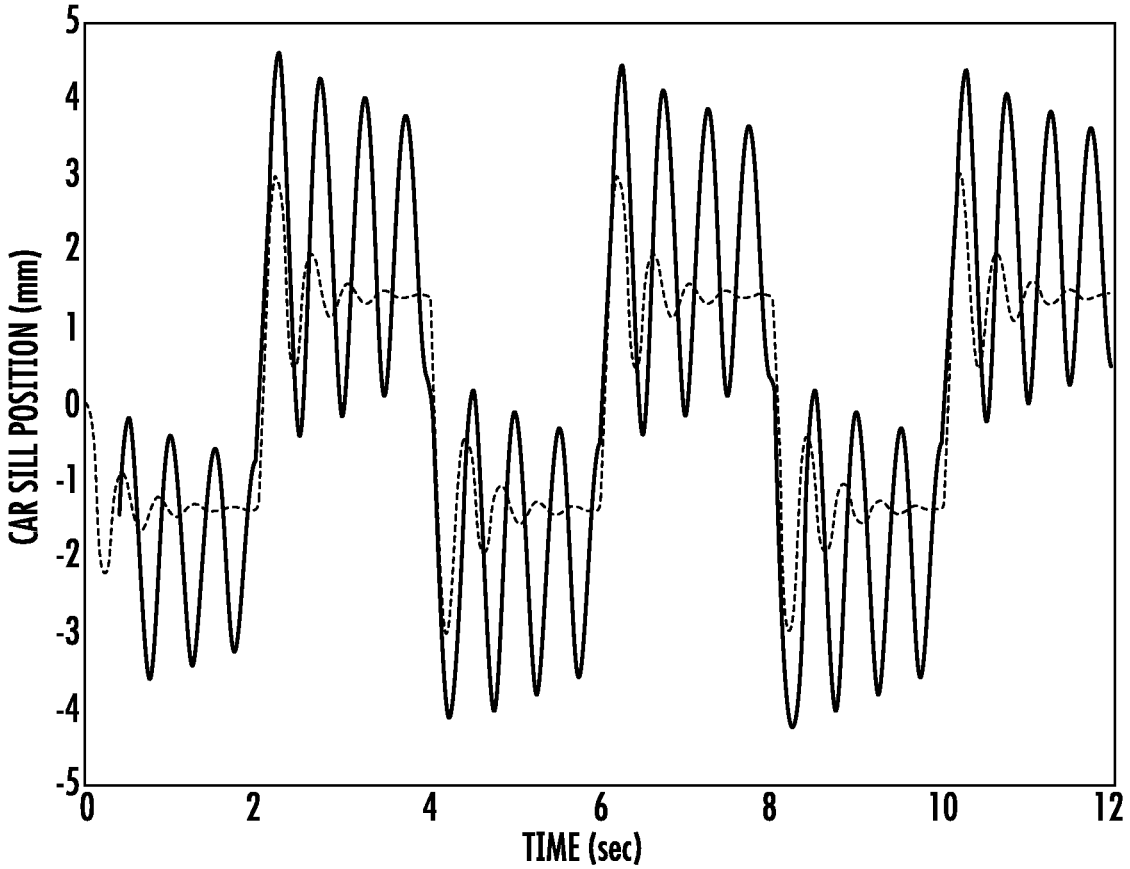
FIG. 5 is a graph comparing oscillation of an elevator car at a landing according to an embodiment.
Figure 6:
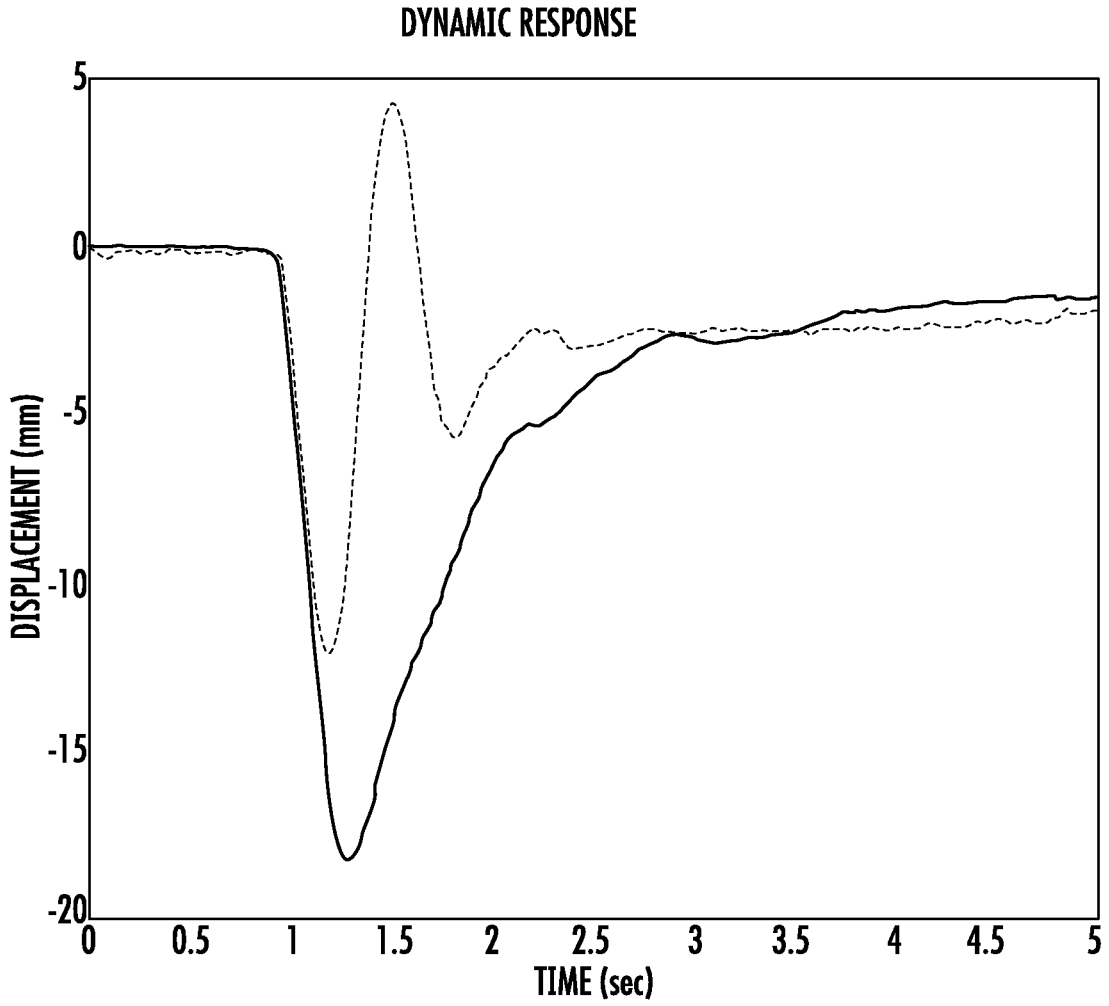
FIG. 6 is a graph comparing the dynamic response of an elevator car at a landing according to an embodiment.

With reference now to FIGS. 5 and 6, various graphs comparing an elevator system 20 with and without a damping device 42 as described herein as illustrated. In the graph of FIG. 5, the oscillation of the elevator car 22 at a landing 40 is illustrated. As can be seen, the oscillation of the car 22 that occurs at a landing 40 having a damping device 42 associated therewith is approximately half of the oscillation that occurs without a damping device. Further, the amplitude of the oscillation decays at a much greater rate in embodiments including a damping device 42 than embodiments without. Similarly, with respect to FIG. 6, the displacement of the dynamic response of an elevator car 22 is similarly reduced by approximately half when used in conjunction with one or more damping devices 42.

The damping device 42 illustrated and described herein provides a solution for stabilizing an elevator car against dynamic sag or bounce. In addition, the damping assemblies 70 of the damping device 42 may be tuned at a factory, or alternatively, in the field to achieve a desired stiffness based on the design, frequency, and amplitude of the elevator system 20. Alternatively, a damping device 42 where the damping assemblies 70 include one or more damping mechanisms 60 that can be electronically or magnetically tuned or adjusted are also contemplated herein. In an embodiment, the damping mechanisms 60 may be tuned in response to feedback, such as provided by a car mounted sensor or another service tool for example. Such adjustment may occur automatically, or manually. Further, because door alignment positions are well controlled to ensure that the car is aligned with a landing, enhanced alignment between the coupling component 44 and the damping device 42 may be achieved, thereby limiting the need for maintenance.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A damping device for damping oscillation of a parked car in an elevator system, the damping device comprising:

a base plate; and at least one damping assembly connected to the base plate, the at least one damping assembly including a first damping assembly and a second damping assembly separated by a clearance configured to receive a coupling component of the parked car, the at least one damping assembly including:

a flange extending from the base plate;

a support member arranged at a distance from the flange; and at least one damping mechanism having a first end connected to the flange and a second end connected to the support member, wherein the at least one damping mechanism restricts oscillation of the support member toward the flange.

2. The damping device of claim 1, wherein the at least one damping mechanism includes a plurality of damping mechanisms, the plurality of damping mechanisms being substantially identical.

3. The damping device of claim 1, wherein the at least one damping mechanism is tunable to achieve a desired stiffness.

4. The damping device of claim 1, wherein the at least one damping mechanism includes a damper and biasing mechanism.

5. The damping device of claim 1, wherein the at least one damping mechanism includes a magnetic spring.

6. The damping device of claim 1, wherein the at least one damping mechanism includes a magnet.

7. The damping device of claim 1, wherein the clearance is defined between the support member of the first damping assembly and the support member of the second damping assembly.

8. The damping device of claim 1, wherein the first damping assembly is operable to restrict oscillation of the parked car in a first direction and the second damping assembly is operable to restrict oscillation of the parked car in a second, opposite direction.

9. An elevator system comprising:

an elevator car;

a plurality of load bearing members suspending the elevator car for oscillation between a plurality of parked positions;

a coupling component; and a damping device engagable with the coupling component at one of the plurality of parked positions, wherein one of the coupling component and the damping device is mounted to the elevator car, the damping device having at least one damping assembly including:

a flange;

a support member arranged at a distance from the flange; and at least one damping mechanism having a first end connected to the flange and a second end connected to the support member, wherein the at least one damping assembly restricts oscillation of the elevator car in at least a first direction;

wherein when the coupling component and the damping device are engaged, the coupling component is arranged in contact with the support member.

10. The elevator system of claim 9, wherein the damping device includes a first damping assembly and a second damping assembly, wherein the first damping assembly restricts oscillation of the elevator car in a first direction and the second damping assembly restricts oscillation of the elevator car in a second, opposite direction.

11. The elevator system of claim 10, wherein a clearance is defined between the support member of the first damping assembly and the support member of the second damping assembly.

12. The elevator system of claim 11, wherein when the coupling component and the damping device are engaged, the coupling component is received within the clearance, the clearance being smaller than the coupling component.

13. The elevator system of claim 9, wherein the elevator car includes a car door and the damping device is aligned with car door when the elevator car is at one of the plurality of parked positions.

14. A method of controlling a position of an elevator car comprising:

stopping the elevator car in a desired position;

engaging a coupling component and a damping device located at the desired position, wherein engaging the coupling component and the damping device includes receiving the coupling component within a clearance defined between a first damping assembly and a second damping assembly;

initially deflecting at least one of the first damping assembly and the second damping assembly; and further deflecting the at least one of the first damping assembly and the second damping assembly in response to oscillation of the elevator car at the desired position.

15. The method of claim 14, wherein the elevator car is at a landing when in the desired position.

16. The method of claim 14, wherein one of the coupling component and the damping device is coupled to a movable component of the elevator car.

* * * * *